US011355266B2

(12) United States Patent
Janssen et al.

(10) Patent No.: US 11,355,266 B2
(45) Date of Patent: Jun. 7, 2022

(54) TWO-WIRE LINE HAVING NESTED INSULATION, METHOD AND DEVICE FOR SUCH A LINE

(71) Applicant: LEONI KABEL GMBH, Roth (DE)

(72) Inventors: Bernd Janssen, Friesoythe (DE); Erwin Koeppendoerfer, Schwabach (DE)

(73) Assignee: BIZLINK INDUSTRY GERMANY GMBH, Roth (DE)

( * ) Notice: Subject to any disclaimer, the term of this patent is extended or adjusted under 35 U.S.C. 154(b) by 0 days.

(21) Appl. No.: 16/964,641

(22) PCT Filed: Feb. 15, 2019

(86) PCT No.: PCT/DE2019/200014
§ 371 (c)(1),
(2) Date: Jul. 24, 2020

(87) PCT Pub. No.: WO2019/158169
PCT Pub. Date: Aug. 22, 2019

(65) Prior Publication Data

US 2021/0057130 A1 Feb. 25, 2021

(30) Foreign Application Priority Data

Feb. 19, 2018 (DE) ..... 102018103607.8

(51) Int. Cl.

| | |
|---|---|
| ***H01B 11/02*** | (2006.01) |
| ***H01B 11/00*** | (2006.01) |
| ***H01B 11/18*** | (2006.01) |
| ***H01B 13/08*** | (2006.01) |

(52) U.S. Cl.
CPC ..... *H01B 11/002* (2013.01); *H01B 11/1847* (2013.01); *H01B 13/08* (2013.01)

(58) Field of Classification Search
CPC ..... H01B 11/002; H01B 1/1847; H01B 13/08
USPC ..... 174/110 R, 113 R, 113 C, 113 AS
See application file for complete search history.

(56) References Cited

U.S. PATENT DOCUMENTS

| | | | | |
|---|---|---|---|---|
| 2,116,268 A * | 5/1938 | Klimmer | H01P 3/04 | 174/27 |
| 2,118,907 A | 5/1938 | Unterbusch et al. | | |
| 2,348,752 A * | 5/1944 | Quayle | H01B 11/1847 | 174/27 |
| 2,614,172 A * | 10/1952 | Greenfield | H01P 3/04 | 178/45 |
| 5,286,923 A * | 2/1994 | Prudhon | H01B 7/0233 | 174/107 |

(Continued)

FOREIGN PATENT DOCUMENTS

| | | |
|---|---|---|
| DE | 643555 C | 11/1891 |
| DE | 69111750 T2 | 1/1996 |
| WO | 9828756 | 7/1998 |

*Primary Examiner* — William H. Mayo, III
(74) *Attorney, Agent, or Firm* — Tarolli, Sundheim, Covell & Tummino LLP

(57) ABSTRACT

A two-wire line includes a first conductor. A first dielectric thread is wrapped around the first conductor. The two-wire line includes a second conductor. A second dielectric thread is wrapped around the second conductor. The first conductor and the second conductor are at a distance from one another. The distance is smaller than the sum of the thickness of the first thread and the thickness of the second thread.

8 Claims, 3 Drawing Sheets

(56) References Cited

U.S. PATENT DOCUMENTS

| | | | | |
|---|---|---|---|---|
| 7,525,041 | B2 * | 4/2009 | Howard | F02C 7/00 174/28 |
| 9,748,022 | B2 * | 8/2017 | Gareis | H01B 7/0225 |
| 9,922,751 | B2 | 3/2018 | Zhang et al. | |
| 2004/0074654 | A1 * | 4/2004 | Springer | H01B 11/1847 174/28 |
| 2011/0148541 | A1 | 6/2011 | Sugama | |
| 2017/0287591 | A1 * | 10/2017 | Zhang | H01B 11/20 |

* cited by examiner

TWO-WIRE LINE HAVING NESTED INSULATION, METHOD AND DEVICE FOR SUCH A LINE

RELATED APPLICATIONS

This application filed under 35 U.S.C § 371 is a national phase application of International Application Number PCT/DE2019/200014, filed Feb. 15, 2019, which claims the benefit of German Application No. 10 2018 103 607.8 flied Feb. 19, 2018, the subject matter of which are incorporated herein by reference in their entirety.

TECHNICAL FIELD

Examples refer to concepts for reducing the dielectric constant of a two-wire line and applications regarding this, and in particular to a two-wire line, a method for producing a two-wire line and a device for producing a two-wire line.

BACKGROUND OF THE INVENTION

Two-wire lines may have to be optimized with regard to reducing the dielectric constant and increasing the differential coupling.

A requirement may exist for providing concepts for electric two-wire lines with reduced insertion loss.

According to a first aspect, a two-wire line is provided. The two-wire line comprises a first conductor. A first dielectric thread is wrapped around the first conductor. The two-wire line comprises a second conductor. A second dielectric thread is wrapped around the second conductor. The first conductor and the second conductor are at a distance from one another. The distance is smaller than a sum of a thickness of the first thread and a thickness of the second thread.

According to a second aspect, a method is provided for producing a two-wire line. The method comprises unwinding of a first conductor by a first spool. The method comprises unwinding of a second conductor by a second spool. The method comprises providing the first conductor with a first dielectric thread. The method comprises providing the second conductor with a second dielectric thread. The method comprises assembly of the first conductor provided with the first dielectric thread and the second conductor provided with the second dielectric thread. The first conductor and the second conductor are (following the step of assembly) at a distance from one another. The distance is smaller than a sum of a thickness of the first thread and a thickness of the second thread.

According to a third aspect, a device is provided for producing a two-wire line. The device comprises a first unwinding unit. The first unwinding unit is designed to unwind a first conductor. The device comprises a second unwinding unit. The second unwinding unit is designed to unwind a second conductor. The device comprises a first wrapping unit. The first wrapping unit is designed to provide the first conductor with a first dielectric thread. The device comprises a second wrapping unit. The second wrapping unit is designed to provide the second conductor with a second dielectric thread. The device comprises a redirection unit. The redirection unit is designed to assemble the first conductor provided with the first dielectric thread and the second conductor provided with the second dielectric thread. The first conductor and the second conductor are at a distance from one another. The distance is (after the step of assembly) smaller than a sum of a thickness of the first thread and a thickness of the second thread.

The first thread can be unwound on the first conductor in the form of a first helix. The second thread can be unwound on the second conductor in the form of a second helix. The first helix and the second helix can be opposed.

The first thread and the second thread can be spaced at a distance.

For example, the first thread can cover less than 50% (or 40% or 30% or 35%) of the first conductor. In addition or alternatively, the second thread can cover less than 50% (or 40% or 30% or 35%) of the second conductor. This can have the advantage that the thread of the respectively other wire fits into this gap. Thick places can be avoided by this if deviations occur during unwinding (not synchronous).

The first thread can touch the second conductor. The second thread can touch the first conductor.

The two-wire line can also have an electrical shield. The electrical shield can enclose at least one area in which the first conductor, the second conductor, the first thread and the second thread are located.

The two-wire line can further have an insulating film. The insulating film can be located, for example, between the shield and the first conductor, the second conductor, the first thread and the second thread.

Even if some of the aspects described above and below are described in relation to the two-wire line, these aspects can also apply to the method and the device. In just the same way, the aspects described above and below in relation to the method can apply in a corresponding manner to the two-wire line and the device. Likewise, the aspects described above and below in relation to the device can apply in a corresponding manner to the two-wire line and the method.

It is likewise understood that the terms used here only serve to describe individual embodiments and are not to be considered a limitation. Unless otherwise defined, all technical and scientific terms used here have the meaning that corresponds to the general understanding of the person skilled in the art in the specialist field relevant for the present disclosure; they should be interpreted neither too broadly nor too narrowly. If technical terms are used here incorrectly and thus do not give expression to the technical idea of the present disclosure, these should be replaced by technical terms that convey a correct understanding to the expert. The general terms used here are to be interpreted on the basis of the definition found in the dictionary or according to the context; too narrow an interpretation is to be avoided in this regard.

It should be understood here that terms such as e.g. "comprise" or "have" etc. signify the presence of the described features, figures, operations, actions, components, parts or their combination and do not exclude the presence or the possible addition of one or more further features, figures, operations, actions, components, parts or their combinations.

Although terms such as "first" or "second" etc. may be used to describe various components, these components are not to be restricted to these terms. It is only intended to distinguish one component from the other using the above terms. For example, a first component can be described as a second component without departing from the protective scope of the present disclosure; likewise, a second component can be described as a first component. The term "and/or" comprises both combination of the several objects in connection with one another and each object of this plurality of the described plurality of objects.

If it says here that a component is "connected to" another component, thus is "in connection with" it or "accesses it", this can mean that it is directly connected to it or accesses this directly; it should be noted in this case, however, that another component may lie in between. If it says, on the other hand, that a component is "directly connected" to another component or "directly accesses it", it should be understood by this that no other components are present in between.

The preferred embodiments of the present disclosure are described below with reference to the enclosed drawings; here similar components are always provided with the same reference characters. In the description of the present disclosure, detailed explanations of known associated functions or structures are omitted if these divert attention unnecessarily from the sense of the present disclosure; such functions and structures are comprehensible to the person skilled in the art, however. The enclosed drawings of the present disclosure serve to illustrate the present disclosure and are not to be understood as a limitation. The technical idea of the present disclosure is to be interpreted in such a way that in addition to the enclosed drawings it also comprises all such modifications, changes and variants.

Other aims, features, advantages and application possibilities result from the following description of exemplary embodiments, which are not to be understood as restrictive, with reference to the associated drawings. In this case all features that are described and/or depicted show per se or in any combination the subject matter disclosed here, even independently of their grouping in the claims or their back references. The dimensions and proportions of the components shown in the figures are not necessarily to scale here; they may deviate from what is illustrated here in embodiments to be implemented.

DETAILED DESCRIPTION

Figure 1:
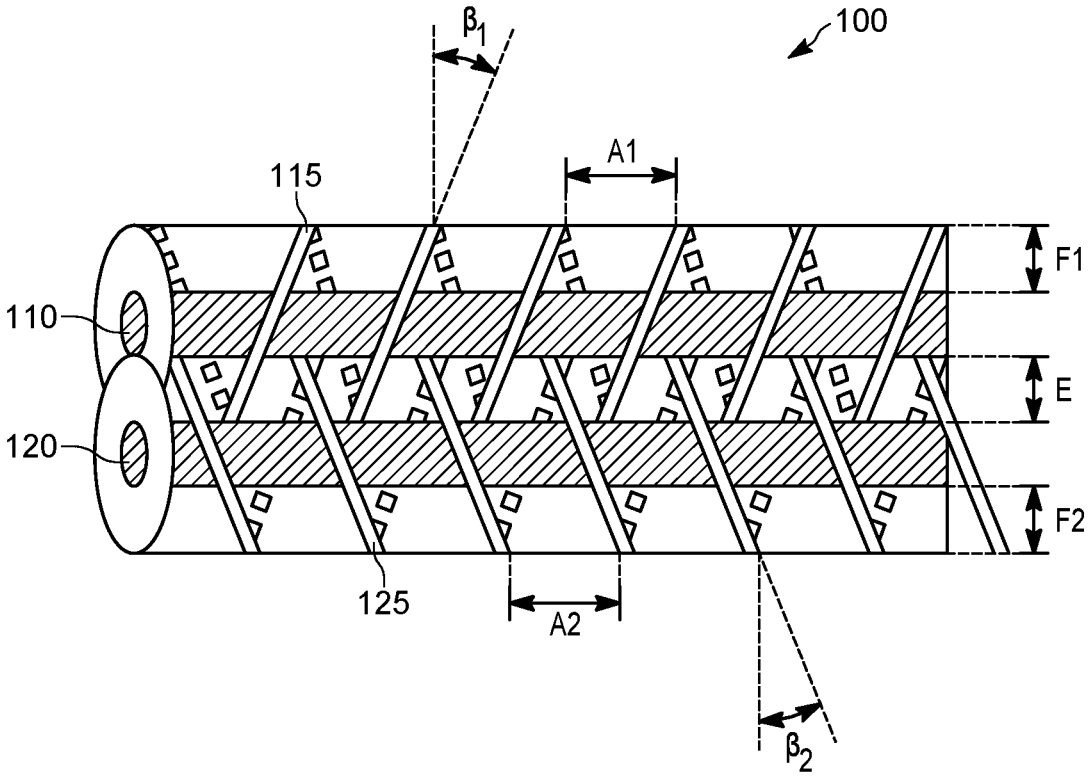
FIG. 1 shows a schematic depiction of a two-wire line (longitudinal view)

The method variants described here of the disclosure and their functional and operating aspects serve only for a better understanding of its structure, mode of operation and properties; they do not restrict the disclosure to the exemplary embodiments, for example. The figures are partly schematic, wherein substantial properties and effects are depicted in part considerably enlarged or reduced in order to clarify the functions, active principles, technical configurations and features. In this case each mode of operation, each principle, each technical configuration and each feature which is/are disclosed in the figures or in the text can be combined freely and in any way with all claims, each feature in the text and in the other figures, other modes of operation, principles, technical configurations and features that are contained in this disclosure or result from it, so that all conceivable combinations are to be associated with the devices described. Combinations between all individual implementations in the text, meaning in each section of the description, in the claims and also combinations between different variants in the text, in the is claims and in the figures are also comprised here and can be made the subject matter of other claims. Nor do the claims limit the disclosure and thus the combination possibilities of all features displayed. All disclosed features are also disclosed here explicitly individually and in combination with all other features.

The two-wire line, the method and the device are now described on the basis of exemplary embodiments.

In the following, without being restricted hereto, specific details are set out to supply a complete understanding of the present disclosure. It is clear to a person skilled in the art, however, that the present disclosure can be used in other exemplary embodiments that may deviate from the details set out below.

While other examples are accordingly suitable for various modifications and alternative forms, some examples of the same are shown by way of example in the figures and described here in detail. It is understood, however, that it is not intended to limit examples to the defined forms disclosed. Other examples can cover all modifications, equivalents and alternatives falling in the context of the disclosure. In the description of the figures as a whole, identical reference characters relate to identical or similar elements, which can be implemented identically or in modified form in comparison with one another, while they provide the same or a similar functionality.

It is understood that if an element is described as "connected" or "coupled" to another element, the elements can be directly connected or coupled or via one or more intermediate elements. If two elements A and B are connected by an "or", this to be understood in such a way that it discloses all possible combinations, i.e. only A, only B, and A and B. An alternative wording for the same combinations is "at least one of A and B". The same applies to combinations of more than 2 elements.

The terminology used here aims to describe certain examples and should not be restrictive for other examples. If a singular form such as "a" and "the" is used, and the use of just one element is defined neither explicitly nor implicitly as mandatory, other examples can also comprise the plural forms to implement the same functionality. In a similar manner, if a functionality is described below such that it is implemented using several elements, other examples can implement the same functionality using a single element or a single processing entity. It is further understood that the terms "comprises", "comprising", "have", "contains", "containing" and/or "having" indicate with this usage the presence of indicated features, integers, steps, operations, elements and/or constituents, but do not exclude the presence or the addition of one or more other features, integers, steps, operations, elements, constituents and/or groups of the same.

Unless otherwise defined, all terms used here (including technical and scientific terms) are used in their usual meaning of the field to which the examples belong.

FIG. 1 shows a schematic depiction of a two-wire line 100 (longitudinal view). The two-wire line 100 comprises a first conductor 110. A first dielectric thread 115 wraps around the first conductor 110. The two-wire line 100 comprises a second conductor 120. A second dielectric thread 125 wraps around the second conductor 120. The first conductor 110 and the second conductor 120 are at a distance E from one another that is smaller than a sum of a thickness F1 of the first thread 115 and a thickness F2 of the second thread 125.

The dielectric constant can be lowered, the differential coupling increased and the insertion loss minimized hereby.

The two-wire line 100 can be shielded, for example (have a shield/screen). The shield can be provided against electromagnetic waves. Furthermore, the two-wire line 100 can have a starting area and an end area. The shield can be located between the starting area and the end area. The first conductor 110, the second conductor 120, the first thread 115 and the second thread 125 can each be located between the starting area and the end area and also extend (for further attachment of the two-wire line 100) from the starting area to the end area. The two-wire line 100 can be connectable via the starting area and the end area.

For example, the first thread 115 can be unwound on the first conductor 110 in the form of a first helix. The second thread 125 can be unwound on the second conductor 120 in the form of a second helix. The first helix and the second helix can be opposed. The expression "opposed" can mean that the first helix is left-handed and the second helix is right-handed. Furthermore, the expression "opposed" can mean that the first helix is right-handed and the second helix is left-handed.

The vector description of a helix in Cartesian coordinates is $$\vec{x}(t) = \begin{pmatrix} r \cdot \cos(2\pi t) \\ r \cdot \sin(2\pi t) \\ h \cdot t + c \end{pmatrix}$$

Here $t \in \mathbb{R}$ is the number of turns passed through from $\vec{x}(0)$

Figure 2:
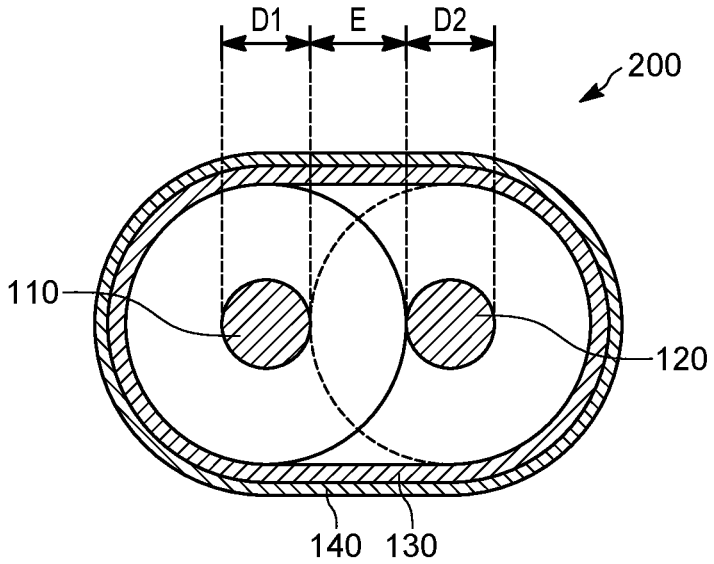
FIG. 2 shows a schematic depiction of a two-wire line (transverse view)

Here h is the pitch (see A1 and A2 in FIG. 1), thus the distance by which the respective (first/second) thread winds in a full revolution in the direction of a cylinder axis of the respective (first/second) conductor; z-direction), r is the radius (see FIG. 2: D1/2+F1 and D2/2+F2) and c is the displacement of the respective (first/second) thread in the z-direction. In a synchronous sequence when wrapping the first and second thread around the first and second conductor, the displacement c can be the same for both threads.

$$\beta = \frac{h}{2\pi r}$$

is the slope of the helix: the helix becomes a straight line with the slope β, when the helical cylinder jacket (first/second thread) is unwound in one plane.

For example, the first thread 115 (along the first conductor 115) can have a first slope β1. The second thread 125 (along the second conductor 125) can have a second slope β2. The first slope β1 and the second slope β2 can each be between 30° and 60°. The first slope β1 and the second slope β2 can each be greater than 30° (or 35° or 40°). The first slope β1 and the second slope β2 can each be smaller than 60° (or 55° or 50° or 45°). The first slope β1 and the second slope β2 can differ by less than 5°, for example. The slopes can be the same on average. Nesting of the two threads can be prevented hereby.

For example, the first thread 115 and the second thread 125 can be spaced at a distance. The first thread 115 and the second thread 125 cannot touch one another, for example, along the first conductor 110 and the second conductor 120. The first conductor 110 and the second conductor 120 run parallel to one another, for example. The first conductor 110 and the second conductor 120 can run parallel within an area that is shielded. The area can be located between the starting area and the end area of the two-wire line 100.

For example, the first thread 115 and the second thread 125 can each be a thread of polyethylene (PE).

For example, the first thread 115 can cover less than 50% (or 40% or 30% or 25%) of the first conductor 110. The second thread 125 can cover less than 50% (or 40% or 30% or 25%) of the second conductor 120. If the first and the second thread cover more than 50% of the respective conductor, the first/second thread can dip maximally partially into the interstice of the second/first thread. The distance of the first conductor 110 from the second conductor 120 can hereby be between 1.5× and 1.8× the thickness of one of the two threads.

For example, the first thread 115 can touch the second conductor 120 (in places at which the second thread 125 does not touch/cover the second conductor 120). The second thread 125 can touch the first conductor 110 (in places at which the first thread 115 does not touch/cover the first conductor).

Other details and aspects are mentioned in connection with the exemplary embodiments described above or below. The exemplary embodiment shown in FIG. 1 can have one or more optional additional features, which correspond to one or more aspects which are mentioned in connection with the proposed concept or below in relation to the exemplary embodiments described in FIGS. 2-4.

FIG. 2 shows a schematic depiction of a two-wire line 200 (transverse view). In the figure an electrical shield 200 is shown (in addition to the two-wire line 100 from FIG. 1). The two-wire line 200 can have the electrical shield 140, for example. The electrical shield 140 can enclose/surround at least one area in which the first conductor 110, the second conductor 120, the first thread 115 and the second thread 125 are located. Within the area the first conductor 110 and the second conductor 120 can run in parallel. Due to the shield 140 a high-frequency coupling can be reduced.

For example, the first conductor 110 and the second conductor 120 can have the same thickness (D1=D2). Due to the same thickness, parallel line guidance of the first conductor 110 and the second conductor 120 inside the shield 140 can be ensured.

In FIG. 2, (in addition to the two-wire line 100 from FIG. 1), an insulating film 130 of the two-wire line 200 is also shown. For example, the two-wire line 200 can also have the insulating film 130. The insulating film 130 can be located between the shield 140 and the first conductor 110, the second conductor 120, the first thread 115 and the second thread 125. The insulating film 130 can extend beyond a first end area of the shield 140. The insulating film 130 can extend beyond a second end area of the shield 140. Furthermore, the shield 140 can comprise only two end areas, for example, namely the first end area and the second end area. The first end area of the shield 140 can be attached to the starting area of the two-wire line 100. The first end area can constitute a ground for further connection of the two-wire line 100. Furthermore, the second end area of the shield 140 can be attached to the end area of the two-wire line 100. The second end area can constitute a ground for further connection of the two-wire line 100.

Other details and aspects are mentioned in connection with the exemplary embodiments described above or below. The exemplary embodiment shown in FIG. 2 can have one or more optional additional features, which correspond to one or more aspects which are mentioned in connection with the proposed concept or one or more exemplary embodiments described above (e.g. FIG. 1) or below (e.g. FIGS. 3-4).

Figure 3:
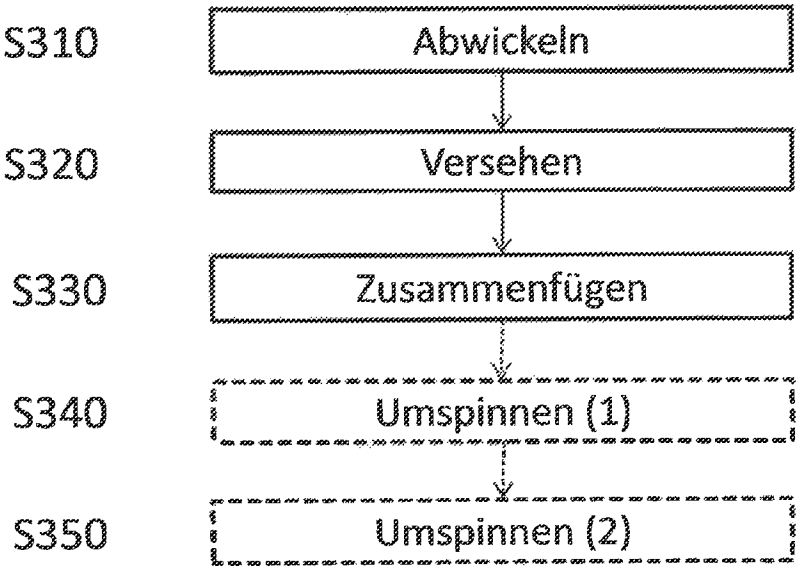
FIG. 3 shows a schematic depiction of a method for producing a two-wire line.

FIG. 3 shows a schematic depiction of a method for producing a two-wire line. The method comprises unwinding S310 of a first conductor by a first spool. The method comprises unwinding S310 of a second conductor by a second spool. The method comprises provision S320 of the first conductor with a first dielectric thread. The method comprises provision S320 of the second conductor with a second dielectric thread. The method comprises assembly S330 of the first conductor provided with the first dielectric thread and the second conductor provided with the second dielectric thread. The first conductor and the second conductor can be at a distance from one another. The distance (following the step of assembly) can be smaller than a sum of a thickness of the first thread and a thickness of the second thread.

For example, the step of provision 320 can further comprise wrapping 320 of the first conductor with the first dielectric thread. The step of provision 320 can further comprise wrapping 320 of the second conductor with the second dielectric thread. The wrapping 320 can take place in opposite directions.

For example, the first spool can rotate opposite to the second spool.

The expression "opposite" can be understood here in such a way that the first spool rotates clockwise and the second spool rotates counter-clockwise or vice versa, or that in the step of provision 320, the wrapping 320 of the first conductor takes place clockwise/counter-clockwise and the wrapping 320 of the second conductor takes place accordingly counter-clockwise/clockwise.

For example, the step of provision 320 can take place during the step of unwinding 310 of the first and second conductor (simultaneously). The unwinding 310 of the first conductor and the unwinding of the second conductor can take place synchronously. The provision 320 of the first conductor with the first dielectric thread can happen synchronously with the provision 320 of the second conductor with the second dielectric thread. It can thus be ensured that the two threads are applied uniformly to reciprocal points of the respective other conductor and thus fit into the gaps of the respective other conductor. The distance E between the first and second conductor can thereby be reduced. The distance E can be greater than one of the thicknesses (F1 or F2) of the pertinent thread. If the pertinent thickness (F1 or F2) is not constant over the length of the pertinent thread (in an area between the first and second conductor), the distance E can be greater than a minimum of the one thickness F1 or the other thickness F2. The minimum of the thickness F1 or of the thickness F2 can be located between a starting area and an end area of the two-wire line. Furthermore, parallelism of the two-wire line can be ensured by the simultaneous and synchronous unwinding 310/wrapping 320.

For example, the method can comprise the step of spinning (1) S340 an insulating as layer around the two-wire line. The insulating layer can serve for better insulation. The insulating layer can also represent a protective spacing from a screen of the two-wire line.

For example, the method can comprise the step of spinning (2) S350 a shield/screen around the two-wire line. The two-wire line can thereby be protected from high-frequency radiation.

The steps of spinning (1) 340 and spinning (2) 350 can be carried out consecutively for a portion of the two-wire line. The portion can be formed from a corresponding first portion of the first conductor provided with the first thread and a second portion of the second conductor provided with the second thread. The first and second portion can have the same length here. The steps S310, S320 and S330 can each be carried out simultaneously for the first and second portion. The steps S310, S320 and S330 can be carried out consecutively here for the corresponding first and second portion.

The screen can define by its first and second end area a limit of the starting area and the end area respectively of the two-wire line.

The aforesaid steps S310, S320, S330, S340 and S350 can be carried out simultaneously. Furthermore, the aforesaid steps S310, S320, S330, S340 and S350 can be carried out consecutively in their stated order for an explicit portion of the pertinent conductor (S310, S320, S330) and for the pertinent portion of the two-wire line (S340, S350).

Other details and aspects are mentioned in connection with the exemplary embodiments described above or below. The exemplary embodiment shown in FIG. 3 can have one or more optional additional features, which correspond to one or more aspects which are mentioned in connection with the proposed concept or one or more exemplary embodiments described above (e.g. FIG. 1-2) or below (e.g. FIG. 4).

Figure 4:
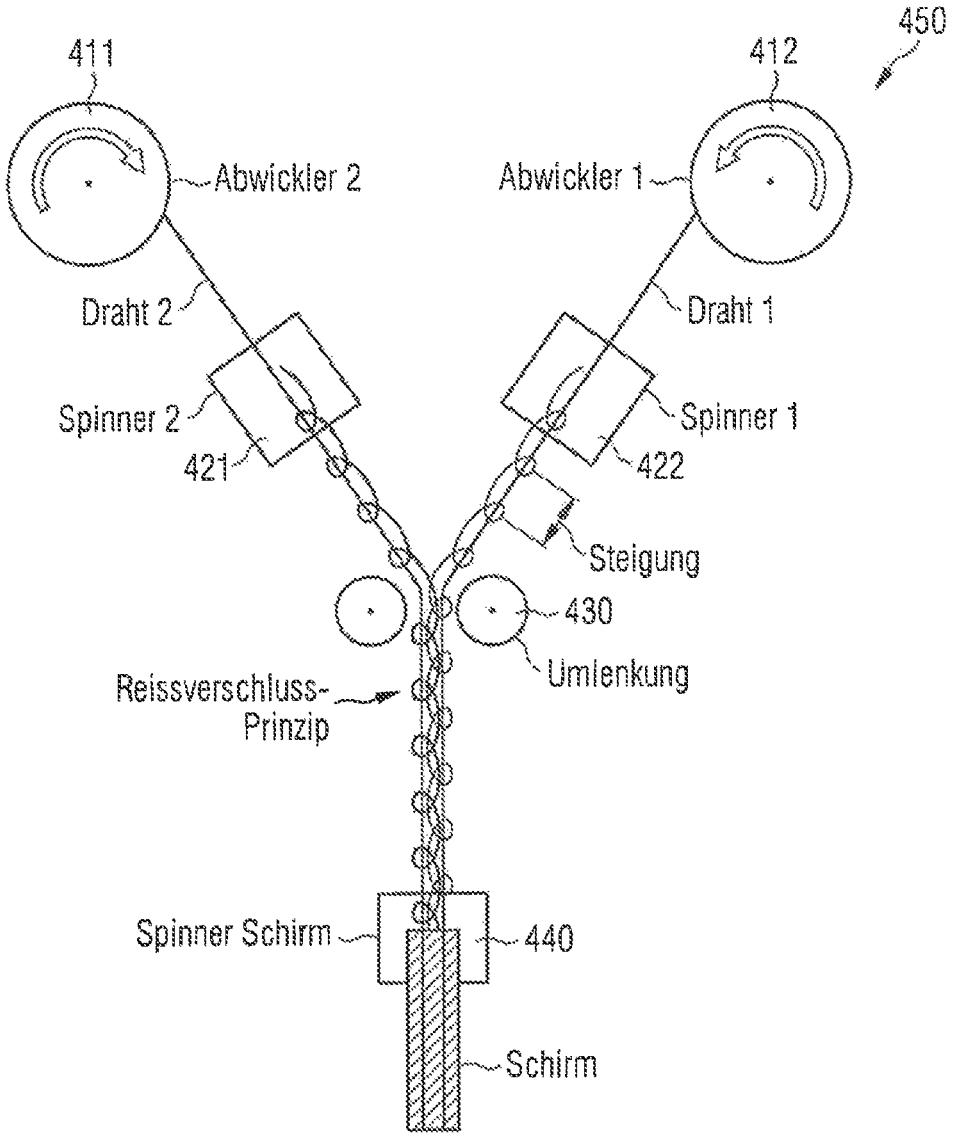
FIG. 4 shows a schematic depiction of a device for producing a two-wire line.

FIG. 4 shows a schematic depiction of a device 450 for producing a two-wire line. The device comprises a first unwinding unit 411. The unwinding unit 411 is designed to unwind a first conductor. The device comprises a second unwinding unit 412. The second unwinding unit 412 is designed to unwind a second conductor. The device comprises a first wrapping unit 421. The first wrapping unit 421 is designed to provide the first conductor with a first dielectric thread. The device comprises a second wrapping unit 422. The second wrapping unit 422 is designed to provide the second conductor with a second dielectric thread. The device comprises a redirection unit 430. The redirection unit 430 is designed to assemble the first conductor provided with the first dielectric thread and the second conductor provided with the second dielectric thread. The first conductor and the second conductor are at a distance from one another. The distance (following the step of assembly) is smaller than a sum of a thickness of the first thread and a thickness of the second thread.

The first unwinding unit 411 and second unwinding unit 412 can each also be described as unwinder (see FIG. 4) or spool (see FIG. 3).

The first wrapping unit and the second wrapping unit can each also be described as spinner (see FIG. 4).

The redirection unit can also be described as redirection (see FIG. 4).

For example, the device 450 can comprise a first spinning unit 435 (not shown). The device 450 can further comprise a second spinning unit 440. The second spinning unit 445 can also be described as a "shield spinner" (see FIG. 4). The second spinning unit 440 can be designed to provide the two-wire line with a shield (against electromagnetic waves). The two-wire line to be produced can be delimited in this case via a starting area and an end area. The two-wire line can further extend beyond a first end area and a second end area of the shield. The starting area of the two-wire line can be adjacent to the first end area of the shield. The end area of the two-wire line can be adjacent to the second end area of the shield. The shield can not extend into the starting area and the end area of the two-wire line, for example. The first spinning unit 435 can be designed to provide the two-wire line with an insulating layer. The insulating layer can completely enclose the two-wire line here (for example, except for the starting area and the end area of the two-wire line).

Other details and aspects are mentioned in connection with the exemplary embodiments described above or below. The exemplary embodiment shown in FIG. 4 can have one or more optional additional features, which correspond to one or more aspects which are mentioned in connection with the proposed concept or one or more exemplary embodiments described above (e.g. FIG. 1-3) or below.

According to one or more exemplary embodiments, a shielded pair (two-wire line) with nested insulation (PE threads) is provided.

When using the two-wire line as a high-speed line in particular, a low dielectric constant and a high differential coupling of the first and second conductor can as positively influence the insertion loss.

According to one or more exemplary embodiments, a spiral dielectric (e.g. PE thread) can be spun respectively synchronously in different directions around two wires (first and second conductor). The two wires can be provided in turn with a shield. The two spiral dielectrics can nest in one another. The distance of the wires from one another (in relation to the distance from the shield) can thereby be reduced. Furthermore, the relative dielectric constant between the wires can be reduced in comparison. This can increase the differential coupling.

According to one or more exemplary embodiments, the two-wire line can be introduced into a coaxial line as an inner conductor.

According to one or more exemplary embodiments, instead of extruding a cellular or non-cellular insulation, an insulating thread (spiral dielectric) can be spun around the first and second conductor (wires of the two-wire line) respectively. A high "air content" can thus arise, which has a smaller dielectric constant in consequence. For example, there are no high-voltage demands on the two-wire line.

The slope of the respective thread in the form of a helix can be so short here that the angle can be between 30° and 60°. Furthermore, the thread can be so narrow that the coverage of the thread on the wire is below 50%. This means that the pitch (gap) of the first/second thread on the first/second conductor can be greater than the first/second thread itself. The corresponding second/first thread (of the adjacent conductor) can lie in this gap. In this case the first thread and the second thread have an identical slope. The first thread and the second thread can thus be applied (synchronously) in different directions (opposedly). Here two spinning modules (first and second wrapping unit) can be coupled synchronously to one another.

According to one or more exemplary embodiments, the distance of the first and second conductor of the two-wire line can have reduced relative to one another. The differential coupling can increase and the insertion loss can be reduced thereby. Another advantage of this high coupling can be an improved symmetry (=>lower mode conversion). Likewise, an almost perfect centricity of the "wires" can be achieved using a spiral dielectric. Due to the fact that two threads are located between the wires (first and second conductor) of the two-wire line, whereas only one is located between wire and shield, the differential coupling can likewise be increased. Working steps such as wire extrusion or extrusion of the inner sheath can also be saved. In addition, even another insulating film can be applied between the (first and second) conductors of the two-wire line and the shield (metallic, e.g. screen against high-frequency coupling). A slow unwinding speed of the two conductors of the two-wire line can be compensated by the fact that spinning/wrapping of both wires (first and second conductor with the corresponding dielectric threads) and the application of a shield (around the first conductor, the second conductor, the first thread and the second thread) can take place in one operation. The reason is that the spinning is a slow working step.

The aspects and features that were mentioned and described together with one or more of the examples and figures described in detail above can further be combined with one or more of the other examples to replace a similar feature of the other example or to introduce the feature additionally into the other example.

The description and drawings represent only the principles of the disclosure. Furthermore, all examples cited here are intended to serve expressly for teaching purposes only to support the reader in understanding the principles of the disclosure and the concepts contributed by the inventor(s) to further development of the art. All statements here regarding principles, aspects and examples of the disclosure as well as particular exemplary embodiments of the same are intended to comprise their equivalents.

A block diagram can present e.g. a detailed circuit diagram, which implements the principles of the disclosure. In a similar manner, a flow chart, flow diagram, state transition diagram, pseudocode and similar can present various processes which can substantially be represented in a computer-readable medium and can thus be executed by a computer or processor, regardless of whether such a computer or processor is expressly presented. Methods disclosed in the description or in the claims can be implemented by a device that has means for executing each of the corresponding steps of these methods.

It is further understood that the disclosure of multiple steps, processes, operations, sequences or functions disclosed in the description or the claims should not be interpreted as being in the defined order unless this is otherwise explicitly or implicitly indicated, e.g. for technical reasons. By the disclosure of several steps or functions, these are therefore not limited to a certain order unless these steps or functions are not interchangeable for technical reasons. Furthermore, in some examples, a single step, a function, a process or sequence can include several sub-steps, -functions, -processes or -sequences or be broken down into these. Such sub-steps can be included and be part of the disclosure of this individual step if not expressly excluded.

Furthermore, the following claims are hereby taken up into the detailed description, where each claim can stand per se as a separate example. If each claim can stand as a separate example per se, it should be noted that—although a dependent claim in the claims can refer to a particular combination with one or more other claims—other exemplary embodiments can also include a combination of the dependent claim with the subject matter of any other dependent or independent claim. These combinations are proposed here unless it is indicated that a certain combination is not intended. Furthermore, features of one claim are also to be included for every other independent claim, even if this claim is not made directly dependent on the independent claim.

The present disclosure is naturally not restricted in any way to the embodiments described previously. On the contrary, many opportunities for modifications thereto are evident to an average person skilled in the art without deviating from the basic idea of the present disclosure as defined in the enclosed claims.

The invention claimed is:

1. Two-wire line having a first conductor, around which a first dielectric thread is wrapped, and a second conductor, around which a second dielectric thread is wrapped, wherein the first conductor and the second conductor are at a distance from one another, which distance is smaller than a sum of a thickness of the first thread and a thickness of the second thread, wherein the first thread is unwound on the first conductor in the form of a first helix and the second thread is unwound on the second conductor in the form of a second helix, and wherein the first helix and the second helix are opposed.

2. Two-wire line according to claim 1, wherein the first thread and the second thread are spaced at a distance.

3. Two-wire line according to claim 1, wherein the first thread covers less than 50% of the first conductor, and wherein the second thread covers less than 50% of the second conductor.

4. Two-wire line according to claim 1, wherein the first thread touches the second conductor, and wherein the second thread touches the first conductor.

5. Two-wire line according to claim 1, wherein the two-wire line also has an electrical shield, wherein the electrical shield encloses at least one area in which the first conductor, the second conductor, the first thread and the second thread are located.

6. Two-wire line according to claim 5, wherein the two-wire line also has an insulating film, which is located between the shield and the first conductor, the second conductor, the first thread and the second thread.

7. Method for producing a two-wire line, the method comprising:

unwinding of a first conductor by a first spool and a second conductor by a second spool;

provision of the first conductor with a first dielectric thread and the second conductor with a second dielectric thread;

assembly of the first conductor provided with the first dielectric thread and the second conductor provided with the second dielectric thread, wherein the first conductor and the second conductor are at a distance from one another, which distance is smaller than a sum of a thickness of the first thread and a thickness of the second thread, wherein the first thread is unwound on the first conductor in the form of a first helix and the second thread is unwound on the second conductor in the form of a second helix, and wherein the first helix and the second helix are opposed.

8. Device for producing a two-wire line, wherein the device has:

a first unwinding unit, which is designed to unwind a first conductor;

a second unwinding unit, which is designed to unwind a second conductor;

a first wrapping unit, which is designed to provide the first conductor with a first dielectric thread;

a second wrapping unit, which is designed to provide the second conductor with a second dielectric thread;

a redirection unit, which is designed to assemble the first conductor provided with the first dielectric thread and the second conductor provided with the second dielectric thread, wherein the first conductor and the second conductor are at a distance from one another, which distance is smaller than a sum of a thickness of the first thread and a thickness of the second thread, wherein the first thread is unwound on the first conductor in the form of a first helix and the second thread is unwound on the second conductor in the form of a second helix, and wherein the first helix and the second helix are opposed.

* * * * *